US011375810B2

(12) United States Patent
Chen et al.

(10) Patent No.: US 11,375,810 B2
(45) Date of Patent: Jul. 5, 2022

(54) CONNECTION DEVICE

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 95 days.

(21) Appl. No.: 16/890,223

(22) Filed: Jun. 2, 2020

(65) Prior Publication Data

US 2021/0212460 A1 Jul. 15, 2021

(30) Foreign Application Priority Data

Jan. 10, 2020 (TW) ..... 109101127

(51) Int. Cl.
*A47B 88/423* (2017.01)
*A47B 88/43* (2017.01)

(52) U.S. Cl.
CPC ..... *A47B 88/43* (2017.01); *A47B 88/423* (2017.01)

(58) Field of Classification Search
CPC ..... A47B 88/43; A47B 88/044; A47B 88/00; A47B 88/40; A47B 88/402; A47B 88/423; A47B 88/4235
USPC ..... 248/200, 201, 298.1; 312/330.1, 352, 312/334.5, 334.32, 334.27; 16/94 R, 96 R
See application file for complete search history.

(56) References Cited

U.S. PATENT DOCUMENTS 5,257,861 A * 11/1993 Domenig ..... A47B 88/43 248/223.41
5,349,723 A * 9/1994 Domenig ..... A47B 88/43 16/383
5,359,752 A * 11/1994 Domenig ..... A47B 88/43 16/383
5,636,820 A * 6/1997 Domenig ..... A47B 88/43 248/200
5,823,648 A * 10/1998 Domenig ..... A47B 88/43 312/334.5
6,494,550 B1 * 12/2002 Chen ..... A47B 88/43 312/334.5

(Continued)

OTHER PUBLICATIONS

International Search Report for corresponding Patent Application 20179496.3-1011.

*Primary Examiner* — Nkeisha Smith
(74) *Attorney, Agent, or Firm* — Rosenberg, Klein & Lee

(57) ABSTRACT

A connection device includes a base and a bracket. The base includes an upper feature, a lower feature, and a middle wall disposed between the upper and the lower features. The middle wall includes a guiding structure and a position-limiting structure that define a moving space therebetween. The bracket is configured to be movably mounted on the base and includes an upper portion, a lower portion, and a middle portion disposed between the upper and the lower portions. The middle portion includes an elastic portion configured to be mounted in the moving space. The upper and the lower portions of the bracket are configured to be mounted to the upper and the lower features of the base respectively.

17 Claims, 8 Drawing Sheets

(56) References Cited

U.S. PATENT DOCUMENTS

| | | | | |
|---|---|---|---|---|
| 6,757,937 | B2 * | 7/2004 | Salice | A47B 88/43 16/94 R |
| 7,090,320 | B2 | 8/2006 | Chen et al. | |
| 8,911,037 | B2 * | 12/2014 | Hightower | A47B 88/423 312/330.1 |
| 9,144,173 | B2 * | 9/2015 | Chen | H05K 7/1489 |
| 10,835,038 | B2 * | 11/2020 | Johannesson | A47B 97/00 |
| 10,905,238 | B1 * | 2/2021 | Shyu | A47B 88/43 |
| 2009/0206716 | A1 * | 8/2009 | Golinski | F16B 12/26 312/334.7 |
| 2011/0234072 | A1 * | 9/2011 | Hightower | A47B 88/43 312/334.5 |

* cited by examiner

CONNECTION DEVICE

FIELD OF THE INVENTION

The present invention relates to a connecting structure and more particularly to a connection device for use with furniture.

BACKGROUND OF THE INVENTION

U.S. Pat. No. 8,911,037 B2 discloses a bracket for mounting a drawer slide to a main panel on a cabinet wall. The main panel has an upper flange, a lower flange, a recess provided between the upper flange and the lower flange, and an access ramp extending between one of the side edges of the main panel and the recess. The main panel is mounted on the cabinet wall. The bracket is attached to the drawer slide. The upper flange and the lower flange of the main panel are configured to capture an upper edge and a lower edge of the bracket respectively. The recess of the main panel is configured to receive a nub of the bracket such that the nub is movable in the recess to allow the horizontal position of the bracket to be adjusted with respect to the main panel.

As the nub is connected to a panel portion of the bracket in a continuous manner and hence cannot be moved with respect to the panel portion of the bracket (i.e., the nub is stationary with respect to the panel portion of the bracket), it can be difficult to mount the bracket to the main panel. To meet different user needs and provide consumers with more alternatives, therefore, it is important to develop connecting products different from the bracket cited above.

SUMMARY OF THE INVENTION

The present invention relates to a connection device configured to facilitate the connection between two objects.

According to one aspect of the present invention, a connection device includes a base and a bracket. The base is provided with an upper feature, a lower feature, and a middle wall disposed between the upper feature and the lower feature. The middle wall has a first side and a second side. A first guiding structure is provided adjacent to one of the first side and the second side, and a first position-limiting structure is provided adjacent to the other of the first side and the second side, wherein the first guiding structure and the first position-limiting structure define a first moving space therebetween. The bracket is configured to be movably mounted on the base and is provided with an upper portion, a lower portion, and a middle portion disposed between the upper portion and the lower portion. The middle portion is provided with a first elastic portion. In the course in which the bracket is mounted to the base from the first side toward the second side of the base in a first direction, the first elastic portion of the bracket is guided into the first moving space by the first guiding structure of the base, and the upper portion and the lower portion of the bracket are mounted to the upper feature and the lower feature of the base respectively.

Preferably, in the course in which the bracket is mounted to the base from the first side toward the second side of the base in the first direction, the first elastic portion of the bracket is guided by the first guiding structure of the base into a state in which the first elastic portion stores an elastic force.

Preferably, a second position-limiting structure is provided adjacent to the one of the first side and the second side of the base, and a second guiding structure is provided adjacent to the other of the first side and the second side of the base, wherein the second guiding structure and the second position-limiting structure define a second moving space therebetween. It is also preferable that the middle portion of the bracket is provided with a second elastic portion, and that in the course in which the bracket is mounted to the base from the first side toward the second side of the base in the first direction, the second elastic portion of the bracket is brought into contact with the second position-limiting structure of the base, releases an elastic force upon moving past the second position-limiting structure, and thus enters the second moving space.

Preferably, in the course in which the bracket is mounted to the base from the second side toward the first side of the base in a second direction, which is the opposite direction of the first direction, the second elastic portion of the bracket is guided into the second moving space by the second guiding structure of the base, and the upper portion and the lower portion of the bracket are mounted to the upper feature and the lower feature of the base respectively.

Preferably, the second elastic portion and the first elastic portion are adjacent to the upper portion and the lower portion of the bracket respectively.

Preferably, the base includes an upper wall and a lower wall. The upper wall includes a first wall section and a second wall section bent with respect to the first wall section, and the first wall section and the second wall section jointly define the upper feature. The lower wall includes a third wall section and a fourth wall section bent with respect to the third wall section, and the third wall section and the fourth wall section jointly define the lower feature.

Preferably, the second wall section of the base is substantially perpendicularly connected to the first wall section.

Preferably, the fourth wall section of the base is substantially perpendicularly connected to the third wall section.

Preferably, the first elastic portion has a smaller size than the first moving space, and the second elastic portion has a smaller size than the second moving space.

According to another aspect of the present invention, a connection device is configured for use with a piece of furniture that includes a first furniture member and a second furniture member. The connection device includes a base and a bracket. The base is configured to be mounted on the first furniture member and has a first side and a second side. A first guiding structure is provided adjacent to one of the first side and the second side, and a first position-limiting structure is provided adjacent to the other of the first side and the second side, wherein the first guiding structure and the first position-limiting structure define a first moving space therebetween. The bracket is configured to be connected to the second furniture member and be movably mounted on the base and is provided with a first elastic portion. The first elastic portion of the bracket is configured to be mounted in the first moving space of the base.

Preferably, the base includes a connecting hole, and the base is connected to the first furniture member by passing a fixing member through the connecting hole.

Preferably, the base includes at least one mounting feature, and the base is connected to the first furniture member through the at least one mounting feature.

Preferably, the first furniture member is a cabinet, and the second furniture member is a slide rail, wherein the slide rail has a length direction substantially perpendicular to the base.

According to still another aspect of the present invention, a connection device includes a base and a bracket. The bracket is movably mounted on the base. One of the base and the bracket has a first side and a second side. A first guiding structure and a second position-limiting structure are provided adjacent to one of the first side and the second side, and a first position-limiting structure and a second guiding structure are provided adjacent to the other of the first side and the second side. The first guiding structure and the first position-limiting structure define a first moving space therebetween, and the second guiding structure and the second position-limiting structure define a second moving space therebetween. The other of the base and the bracket is provided with a first elastic portion and a second elastic portion. The first elastic portion is configured to be mounted in the first moving space, and the second elastic portion is configured to be mounted in the second moving space.

DETAILED DESCRIPTION OF THE INVENTION

Figure 2:
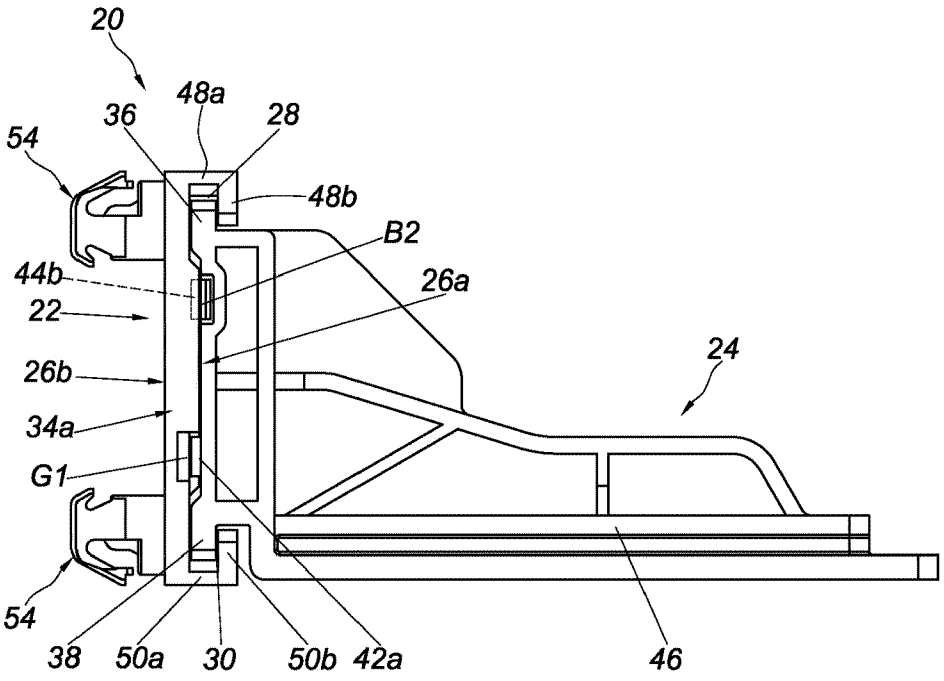
FIG. 2 is a side view of the connection device according to the embodiment of the present invention.
Figure 1:
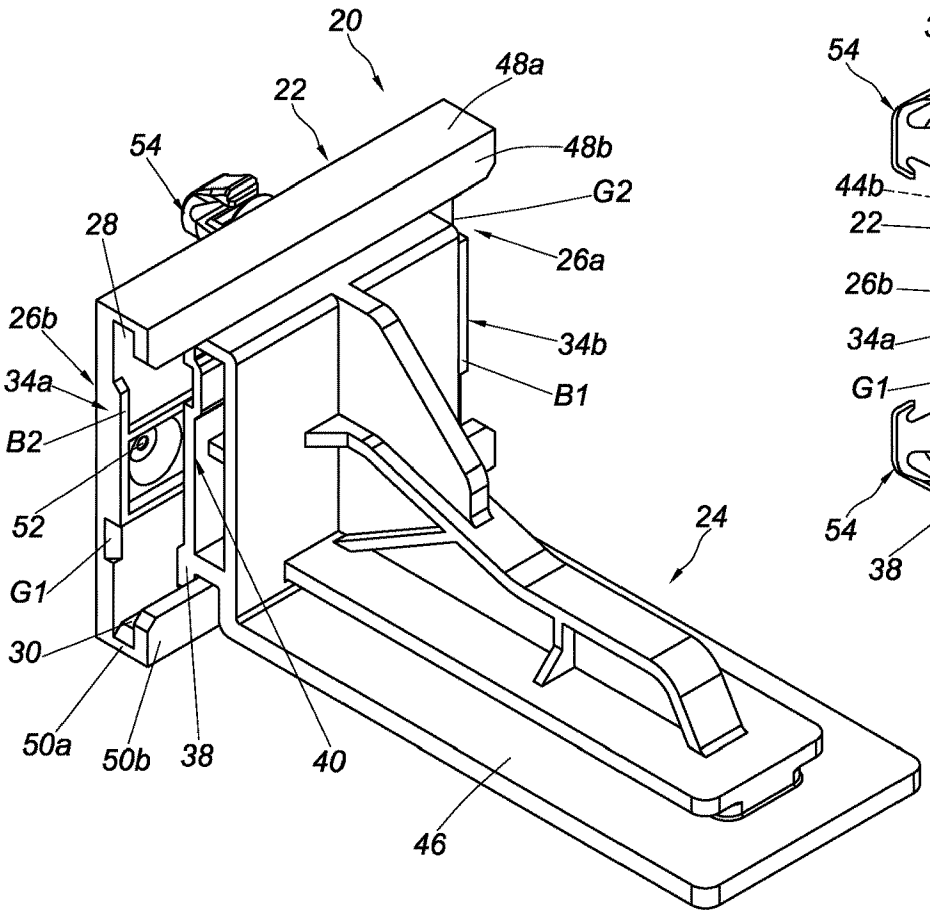
FIG. 1 is a perspective view of the connection device according to an embodiment of the present invention.
Figure 3:
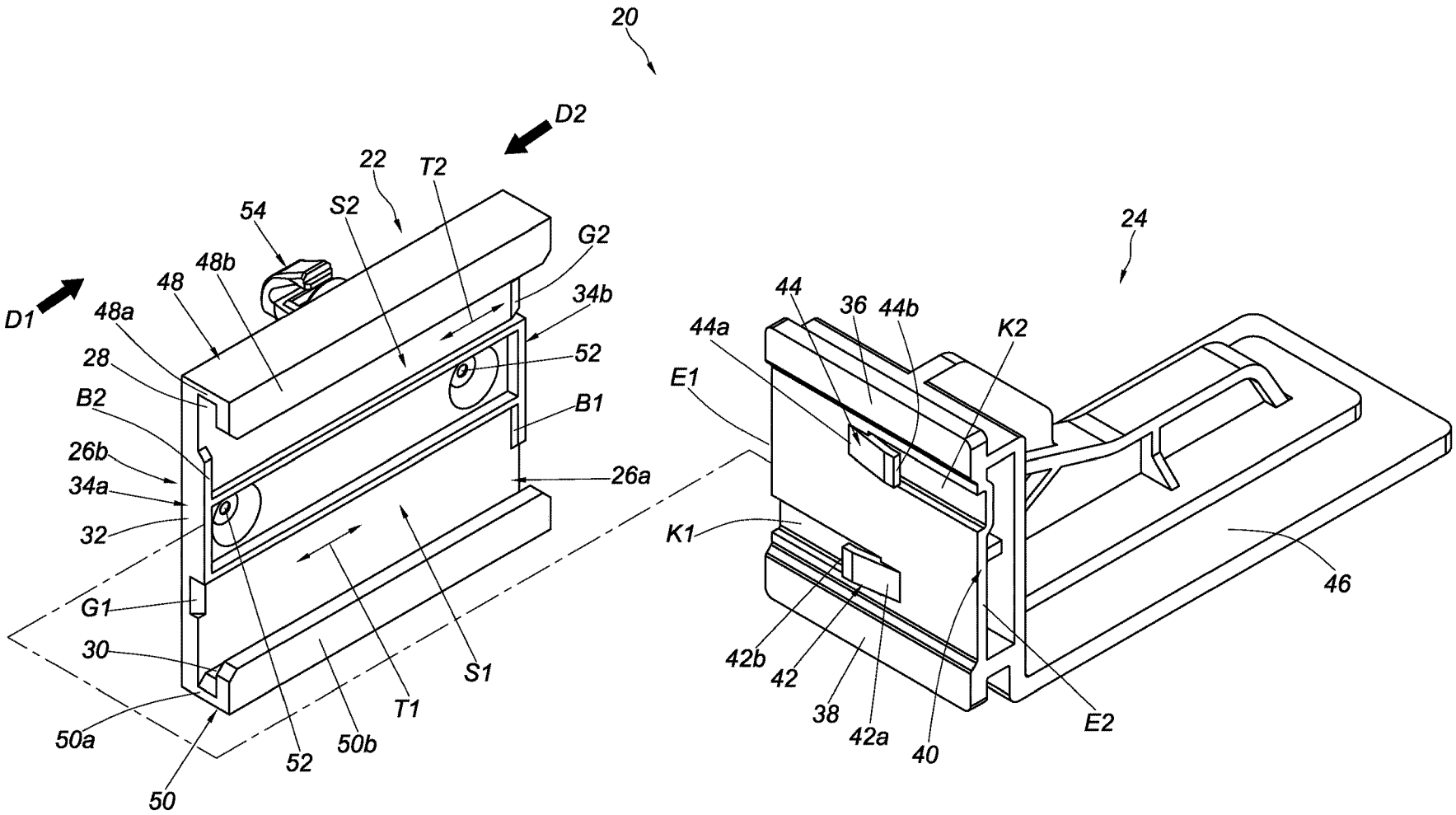
FIG. 3 is an exploded perspective view of the connection device according to the embodiment of the present invention.

Referring to FIG. 1 to FIG. 3, the connection device 20 according to an embodiment of the present invention includes a base 22 and a bracket 24.

The base 22 has two opposite portions defined respectively as a first portion 26*a* and a second portion 26*b*, such as but not limited to a front portion and a rear portion. The first portion 26*a* is provided with an upper feature 28 and a lower feature 30, and the base 22 includes a middle wall 32 provided between the upper feature 28 and the lower feature 30. The middle wall 32 has two opposite sides defined respectively as a first side 34*a* and a second side 34*b*, such as but not limited to a left side and a right side. A first guiding structure G1 is provided adjacent to the first side 34*a*, and a first position-limiting structure B1 is provided adjacent to the second side 34*b*. The first guiding structure G1 and the first position-limiting structure B1 define a first moving space S1 therebetween. The first guiding structure G1 and the first position-limiting structure B1 lie along substantially the same first horizontal direction T1 (e.g., a first transverse direction). Preferably, there are also a second position-limiting structure B2 provided adjacent to the first side 34*a* and a second guiding structure G2 provided adjacent to the second side 34*b*, and the second guiding structure G2 and the second position-limiting structure B2 define a second moving space S2 therebetween. The second guiding structure G2 and the second position-limiting structure B2 lie along substantially the same second horizontal direction T2 (e.g., a second transverse direction). The second horizontal direction T2 is substantially parallel to the first horizontal direction T1. Preferably, the first guiding structure G1 and the second guiding structure G2 have substantially the same structural configuration (e.g., each of the first guiding structure G1 and the second guiding structure G2 includes an inclined surface or a curved surface), and the first position-limiting structure B1 and the second position-limiting structure B2 have substantially the same structural configuration (e.g., the first position-limiting structure B1 is a wall (e.g., a vertical wall or a sidewall) provided on the second side 34*b* of the base 22, and the second position-limiting structure B2 is a wall (e.g., a vertical wall or a sidewall) provided on the first side 34*a* of the base 22).

The bracket 24 is configured to be mounted on the base 22 in a movable manner. For example, the bracket 24 can be adjusted, i.e., displaced, horizontally (e.g., transversely) with respect to the base 22. More specifically, the bracket 24 is provided with an upper portion 36, a lower portion 38, and a middle portion 40 disposed between the upper portion 36 and the lower portion 38. Here, by way of example, the upper portion 36 is an upper flange, and the lower portion 38 is a lower flange. The middle portion 40 is provided with a first elastic portion 42.

Preferably, the middle portion 40 of the bracket 24 is further provided with a second elastic portion 44, and the first elastic portion 42 and the second elastic portion 44 have substantially the same structure but are arranged in opposite directions. For example, the first elastic portion 42 includes a connecting section 42*a* and an end portion 42*b* located away from the connecting section 42*a* (see FIG. 3), the connecting section 42*a* is connected to the middle portion 40 of the bracket 24, and the end portion 42*b* is lifted to a predetermined height with respect to the connecting section 42*a* Similarly, the second elastic portion 44 includes a connecting section 44*a* and an end portion 44*b* located away from the connecting section 44*a* (see also FIG. 3), the connecting section 44*a* is connected to the middle portion 40 of the bracket 24, and the end portion 44*b* is lifted to the predetermined height with respect to the connecting section 44*a*.

Preferably, as shown in FIG. 3, the middle portion 40 of the bracket 24 has a first receiving space K1 and a second receiving space K2, and the first elastic portion 42 and the second elastic portion 44 can be moved with respect to the first receiving space K1 and the second receiving space K2 respectively.

Preferably, the end portion 42*b* of the first elastic portion 42 and the end portion 44*b* of the second elastic portion 44 point to opposite directions. For example, the end portion 42*b* of the first elastic portion 42 points to a first direction D1 whereas the end portion 44*b* of the second elastic portion 44 points to a second direction D2, wherein the first direction D1 and the second direction D2 are two opposite directions, such as but not limited to a rightward direction and a leftward direction.

Preferably, the bracket 24 includes an extension portion 46 extending from the middle portion 40, and the extension portion 46 has a longitudinal length.

Preferably, the second elastic portion 44 and the first elastic portion 42 are adjacent to the upper portion 36 and the lower portion 38 of the bracket 24 respectively.

Preferably, the base 22 includes an upper wall 48 and a lower wall 50. The upper wall 48 includes a first wall section 48*a* and a second wall section 48*b*. The second wall section 48*b* is bent downward with respect to the first wall section 48*a*, and the first wall section 48*a* and the second wall section 48*b* jointly define a groove that serves as the upper feature 28. The lower wall 50 includes a third wall section 50*a* and a fourth wall section 50*b*. The fourth wall section 50*b* is bent upward with respect to the third wall section 50*a*, and the third wall section 50*a* and the fourth wall section 50*b* jointly define a groove that serves as the lower feature 30.

Preferably, the second wall section 48*b* of the base 22 is substantially perpendicularly connected to the first wall section 48*a*, and the fourth wall section 50*b* of the base 22 is substantially perpendicularly connected to the third wall section 50*a*.

Preferably, the base 22 includes at least one connecting hole 52 in communication with the first portion 26*a* and the second portion 26*b*. Here, two connecting holes 52 are provided by way of example.

Preferably, the base 22 includes at least one mounting feature 54 provided on the second portion 26*b*. Here, two mounting features 54 are provided by way of example, and the two mounting features 54 are projections.

Preferably, one of the base 22 and the bracket 24 includes plastic. Here, both the base 22 and the bracket 24 are made of plastic by way of example.

Figure 4:
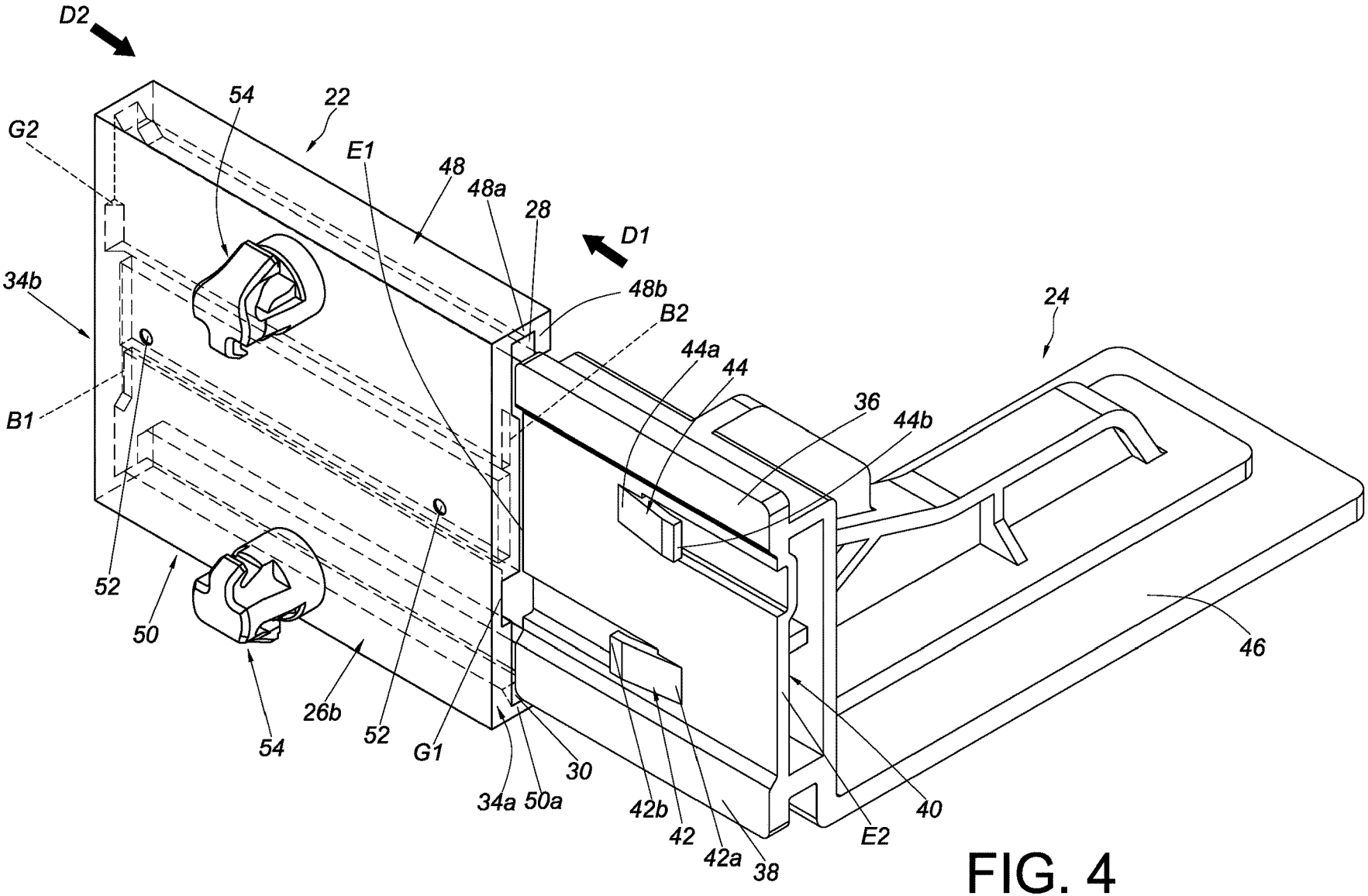
FIG. 4 is a schematic view showing the process by which the bracket of the connection device according to the embodiment of the present invention is mounted to the base of the connection device in a predetermined direction.
Figure 5:
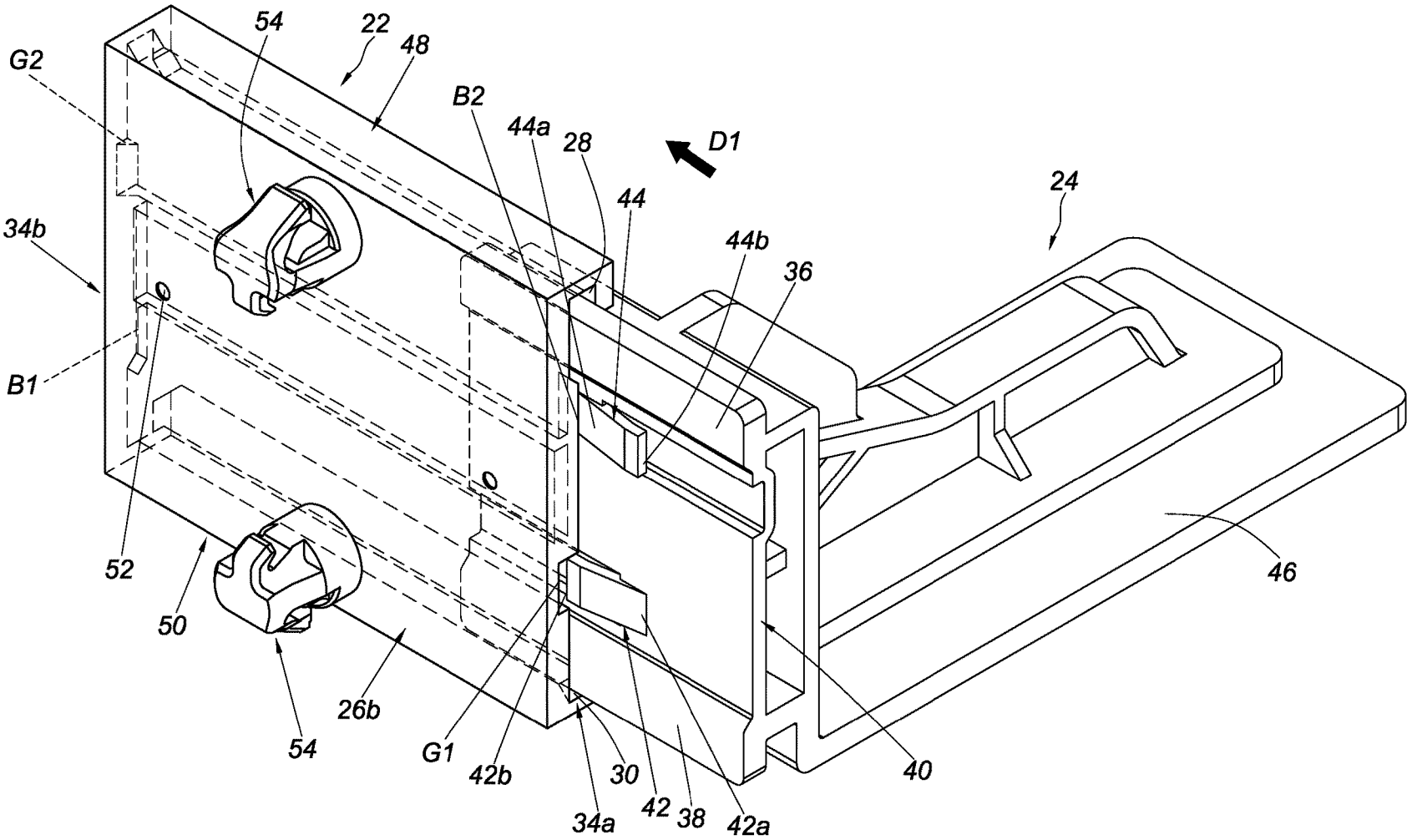
FIG. 5 is a schematic view showing that the bracket of the connection device according to the embodiment of the present invention is further moved in the predetermined direction in order to be mounted on the base.

As shown in FIG. 3 to FIG. 5, the bracket 24 has two opposite edges defined respectively as a first edge E1 and a second edge E2. To assemble the connection device 20, the bracket 24 can be mounted to the base 22 from the first side 34*a* toward the second side 34*b* of the base 22 in the first direction D1, or from the second side 34*b* toward the first side 34*a* of the base 22 in the second direction D2. Here, by way of example, the bracket 24 is mounted to the base 22 in such a way that the first edge E1 of the bracket 24 is moved from the first side 34*a* toward the second side 34*b* of the base 22 in the first direction D1 (see FIG. 4 and FIG. 5). The first elastic portion 42 and the second elastic portion 44 of the bracket 24 are in an initial state before assembly begins. When the bracket 24 is being mounted to the base 22 from the first side 34*a* toward the second side 34*b* of the base 22 in the first direction D1, the end portion 42*b* of the first elastic portion 42 of the bracket 24 comes into contact with the first guiding structure G1 of the base 22 (see FIG. 5), and the connecting section 44*a* of the second elastic portion 44 of the bracket 24 comes into contact with the second position-limiting structure B2 of the base 22 (see also FIG. 5).

Figure 6:
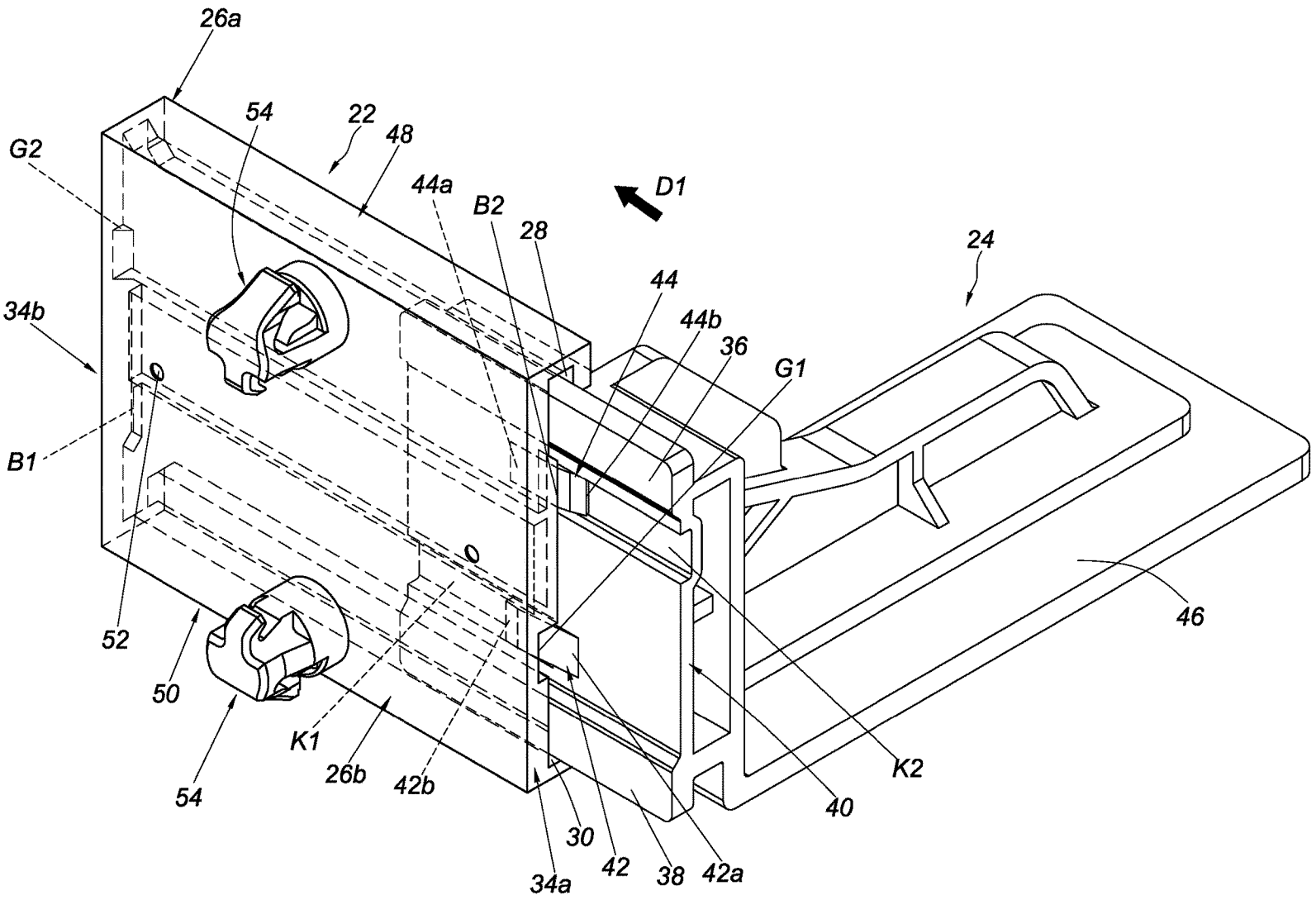
FIG. 6 is a schematic view showing that the bracket of the connection device according to the embodiment of the present invention is further moved in the predetermined direction in order to be mounted on the base.

When the bracket 24 is further moved from the first side 34*a* toward the second side 34*b* of the base 22 in the first direction D1 in order to be mounted on the base 22, referring to FIG. 5 and FIG. 6, the first elastic portion 42 of the bracket 24 is guided by the first guiding structure G1 of the base 22 and is thus brought from the initial state into a state in which the first elastic portion 42 stores a first elastic force (see FIG. 6) in order to be received in the first receiving space K1. On the other hand, the second elastic portion 44 of the bracket 24 is held down by the second position-limiting structure B2 of the base 22 and is thus brought from the initial state into a state in which the second elastic portion 44 stores a second elastic force (see FIG. 6) in order to be received in the second receiving space K2.

Figure 7:
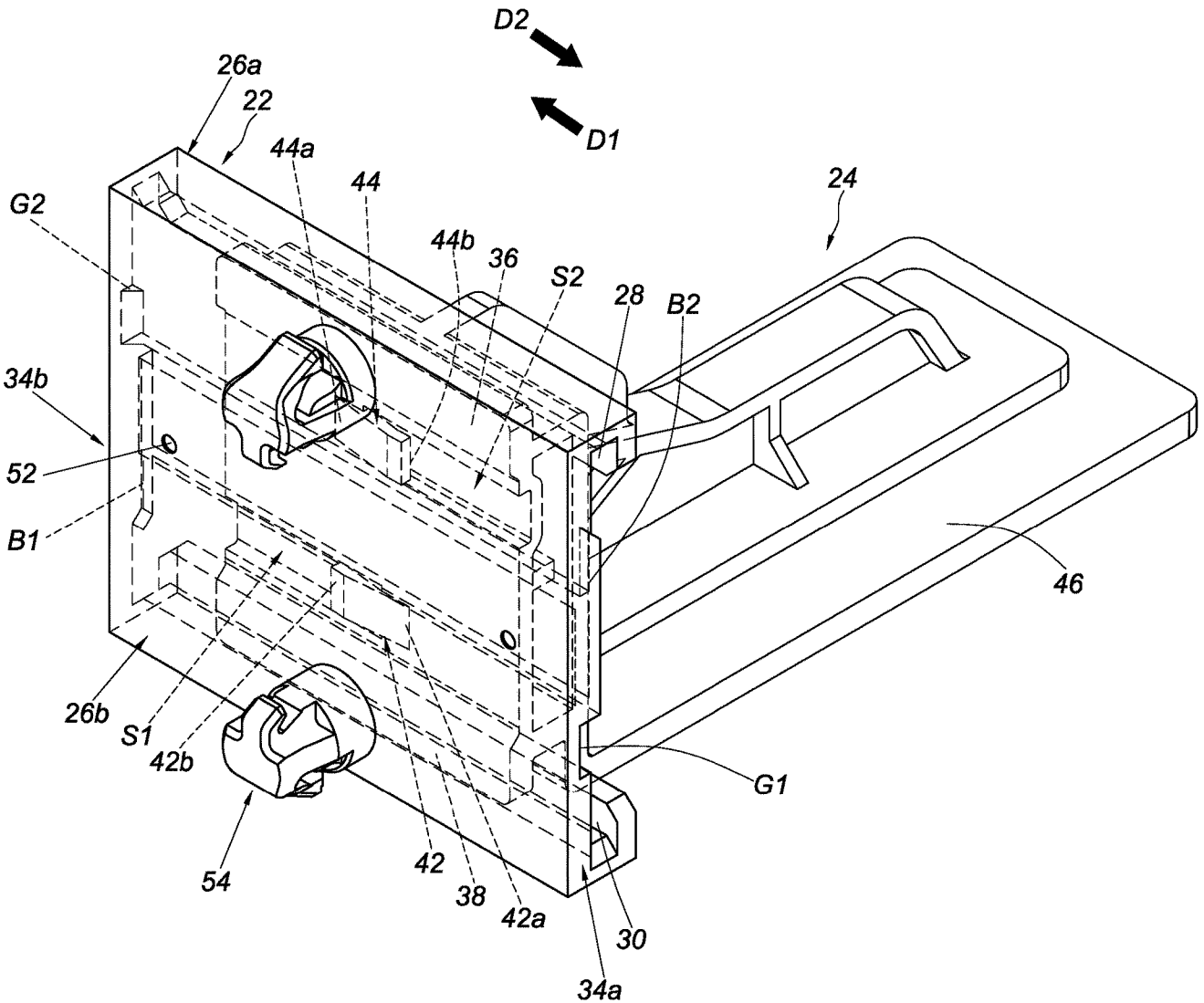
FIG. 7 is a schematic view showing that the bracket of the connection device according to the embodiment of the present invention is mounted on the base.

FIG. 6 and FIG. 7 show how the bracket 24 and the base 22 are eventually mounted on each other. When the bracket 24 is further moved from the first side 34*a* toward the second side 34*b* of the base 22 in the first direction D1 in order to be mounted on the base 22, the first elastic portion 42 of the bracket 24 is mounted into the first moving space S1 of the base 22; for example, the first elastic portion 42 of the bracket 24 is guided into the first moving space S1 by the first guiding structure G1 of the base 22, is held down by the first portion 26*a* of the base 22, and is thus kept in the state in which the first elastic portion 42 stores the first elastic force (see FIG. 7), wherein the first elastic portion 42 has a smaller size than the first moving space S1. On the other hand, the second elastic portion 44 of the bracket 24 is mounted into the second moving space S2 of the base 22; for example, the second elastic portion 44 of the bracket 24 starts with contact with the second position-limiting structure B2 of the base 22, releases the second elastic force upon moving past the second position-limiting structure B2, and ends up in the second moving space S2 (see FIG. 7), wherein the second elastic portion 44 has a smaller size than the second moving space S2. During the process, the upper portion 36 and the lower portion 38 of the bracket 24 are also movably mounted into the upper feature 28 and the lower feature 30 of the base 22 respectively. The operation of mounting the bracket 24 to the base 22 is completed when the first elastic portion 42, the second elastic portion 44, the upper portion 36, and the lower portion 38 of the bracket 24 are all mounted in place.

Referring to FIG. 7, the bracket 24 and the base 22 can be adjusted, i.e., displaced, horizontally (e.g., transversely) with respect to each other once they are mounted on each other. For example, the bracket 24 can be displaced with respect to the base 22 in the first direction D1 as far as a first limit position, where the end portion 42*b* of the first elastic portion 42 of the bracket 24 is blocked by the first position-limiting structure B1 of the base 22 (see FIG. 3). The bracket 24 can also be displaced with respect to the base 22 in the second direction D2 as far as a second limit position, where the end portion 44*b* of the second elastic portion 44 of the bracket 24 is blocked by the second position-limiting structure B2 of the base 22 (see also FIG. 3).

It is worth mentioning that when the bracket 24 is mounted to the base 22 by passing the second edge E2 of the bracket 24 from the second side 34*b* toward the first side 34*a* of the base 22 in the second direction D2, referring to FIG. 3, the second elastic portion 44 of the bracket 24 will be guided into the second moving space S2 by the second guiding structure G2 of the base 22, and the first elastic portion 42 of the bracket 24 will be moved past the first position-limiting structure B1 of the base 22 and end up mounted in the first moving space S1, with the upper portion 36 and the lower portion 38 of the bracket 24 movably mounted in the upper feature 28 and the lower feature 30 of the base 22 respectively. This mounting operation can mount the bracket 24 to the base 22 just as well (see FIG. 7).

Figure 8:
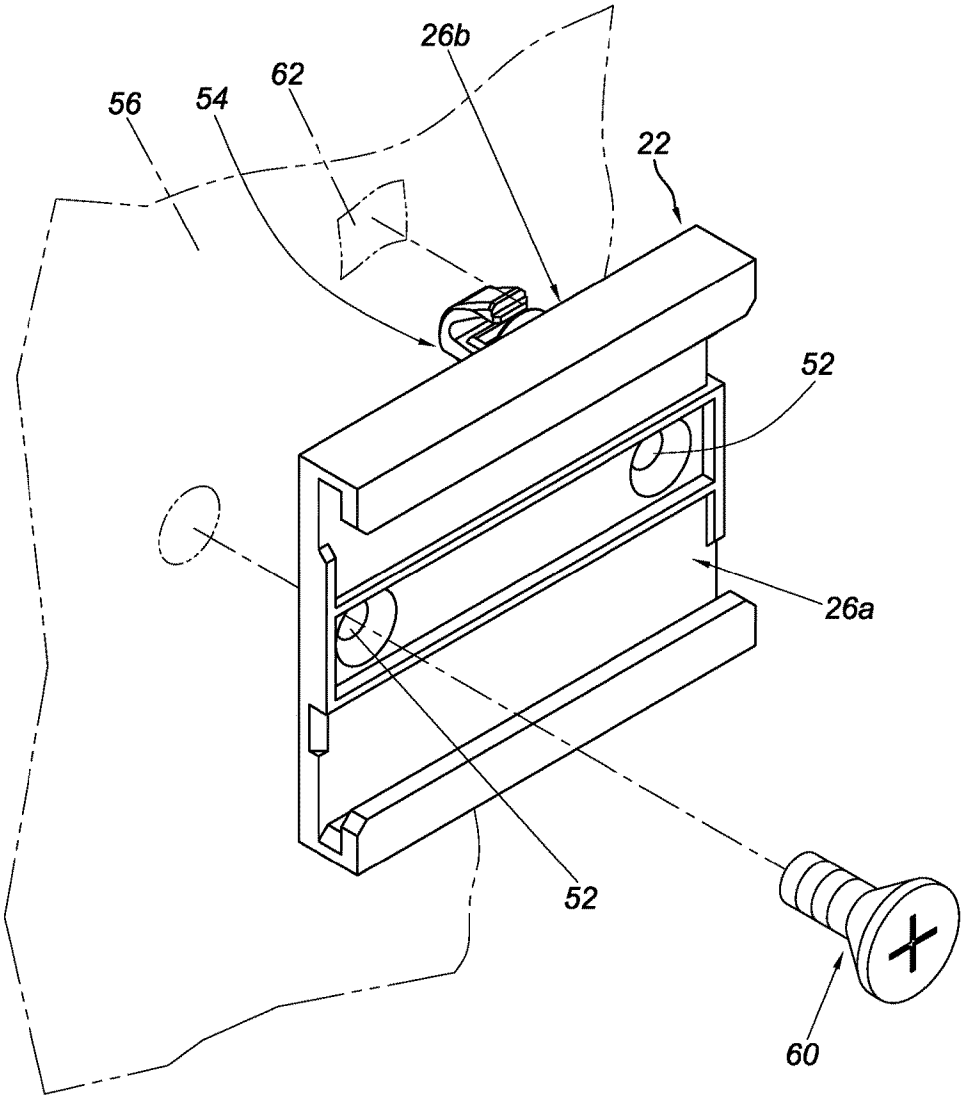
FIG. 8 is a schematic view showing that the base of the connection device according to the embodiment of the present invention is mounted to a first furniture member.
Figure 9:
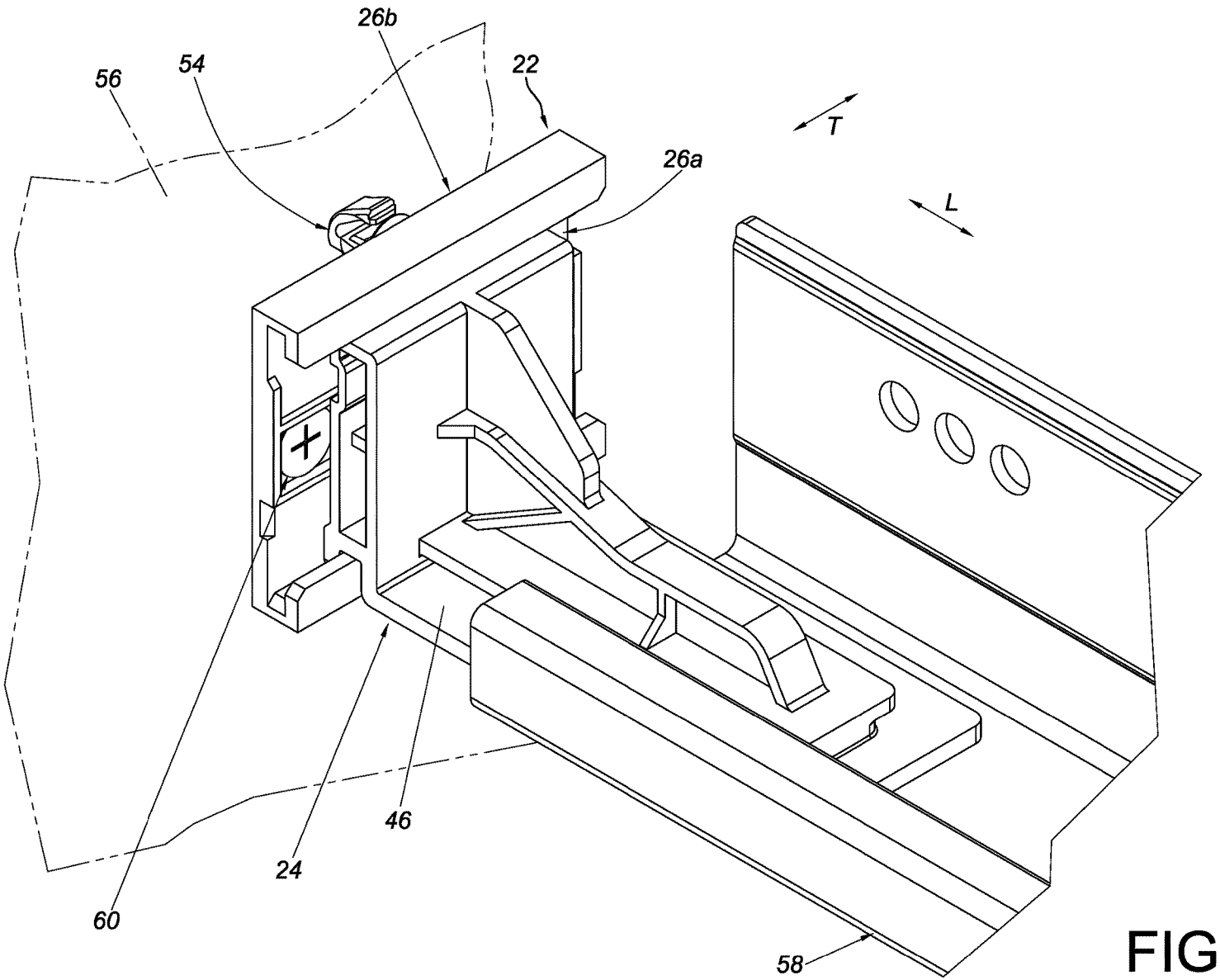
FIG. 9 is a schematic view showing that the base of the connection device according to the embodiment of the present invention is mounted on the first furniture member, and that the bracket of the connection device is mounted on a second furniture member.

Referring to FIG. 8 and FIG. 9, the connection device 20 is applied to a piece of furniture that includes a first furniture member 56 and a second furniture member 58. For example, the first furniture member 56 is a wall (such as but not limited to the rear wall) of a cabinet, and the second furniture member 58 is a slide rail whose longitudinal length direction L is substantially perpendicular to a horizontal direction T (e.g., a transverse direction) defined by the first portion 26*a* of the base 22.

The second portion 26*b* of the base 22 can be connected to the first furniture member 56 by passing at least one fixing member 60 through the at least one connecting hole 52 of the base 22 and/or by connecting the at least one mounting feature 54 of the base 22 to a corresponding feature 62 (e.g., a mounting hole) of the first furniture member 56. The extension portion 46 of the bracket 24 can, on the other hand, be connected to the second furniture member 58. For example, the second furniture member 58 and the extension portion 46 can be connected by mechanical engagement, threaded connection, riveting, or the like; the present invention has no limitation in this regard. The matching structures of the bracket 24 and the base 22 allow the second furniture member 58 and the first furniture member 56 to be adjusted in position with respect to each other. As the principle by which the bracket 24 and the base 22 can be adjusted in position with respect to each other has been disclosed above, the same principle will not be stated repeatedly.

It can be known from the above that the connection device 20 according to the foregoing embodiment preferably has the following features:

1. In contrast to the conventional bracket disclosed in U.S. Pat. No. 8,911,037 B2, whose nub is immovable with respect to the panel portion of the bracket and hence makes it difficult to mount the bracket to the main panel, the bracket 24 in the embodiment described above can be mounted to the base 22 easily and effortlessly thanks to the elasticity of the first elastic portion 42 (or of the second elastic portion 44), which moves elastically to enter the first moving space S1 (or the second moving space S2) of the base 22 while the bracket 24 is being mounted to the base 22.
2. Once mounted on each other, the bracket 24 and the base 22 can be moved with respect to each other. For example, the bracket 24 can be adjusted in position horizontally (in the first direction D1 or the second direction D2) with respect to the base 22.
3. The bracket 24 can be mounted on the base 22 by passing the first edge E1 of the bracket 24 from the first side 34*a* toward the second side 34*b* of the base 22 in the first direction D1, or by passing the second edge E2 of the bracket 24 from the second side 34*b* toward the first side 34*a* of the base 22 in the second direction D2. That is to say, the bracket 24 can be mounted in two directions.
4. The first elastic portion 42 of the bracket 24 can be mounted in the first moving space S1 of the base 22, and the second elastic portion 44 of the bracket 24 can be mounted in the second moving space S2 of the base 22. As the end portion 42*b* of the first elastic portion 42 of the bracket 24 is configured to be blocked by the first position-limiting structure B1 of the base 22, and the end portion 44*b* of the second elastic portion 44 of the bracket 24 by the second position-limiting structure B2 of the base 22, the bracket 24 can be horizontally displaced with respect to the base 22 only within a limited range.
5. The second elastic portion 44 and the first elastic portion 42 are adjacent to the upper portion 36 and the lower portion 38 of the bracket 24 respectively.

While the present invention has been disclosed through the preferred embodiment described above, the embodiment is not intended to be restrictive of the scope of the invention. The scope of the patent protection sought by the applicant is defined by the appended claims.

What is claimed is:

1. A connection device, comprising:

a base provided with an upper feature, a lower feature, and a middle wall disposed between the upper feature and the lower feature, wherein the middle wall has a first side and a second side, a first guiding structure is disposed adjacent to one of the first side and the second side, a first position-limiting structure is disposed adjacent to the other of the first side and the second side, and the first guiding structure and the first position-limiting structure define a first moving space therebetween, a second position-limiting structure is disposed adjacent to the one of the first side and the second side of the base, a second guiding structure is disposed adjacent to the other of the first side and the second side of the base, the second guiding structure and the second position-limiting structure define a second moving space therebetween; and a bracket configured to be movably mounted on the base, wherein the bracket is provided with an upper portion, a lower portion, and a middle portion disposed between the upper portion and the lower portion, and the middle portion is provided with a first elastic portion;

wherein while the bracket is being mounted to the base from the first side toward the second side of the base in a first direction, the first elastic portion of the bracket is guided into the first moving space by the first guiding structure of the base, and the upper portion and the lower portion of the bracket are mounted to the upper feature and the lower feature of the base respectively;

wherein the middle portion of the bracket is provided with a second elastic portion, and while the bracket is being mounted to the base from the first side toward the second side of the base in the first direction, the second elastic portion of the bracket is brought into contact with the second position-limiting structure of the base, releases an elastic force upon moving past the second position-limiting structure, and thus enters the second moving space.

2. The connection device of claim 1, wherein while the bracket is being mounted to the base from the first side toward the second side of the base in the first direction, the first elastic portion of the bracket is guided by the first guiding structure of the base into a state in which the first elastic portion stores an elastic force.

3. The connection device of claim 1, wherein while the bracket is being mounted to the base from the second side toward the first side of the base in a second direction, which is the opposite direction of the first direction, the second elastic portion of the bracket is guided into the second moving space by the second guiding structure of the base, the first elastic portion of the bracket is moved past the first position-limiting structure of the base and is thus mounted in the first moving space, and the upper portion and the lower portion of the bracket are mounted to the upper feature and the lower feature of the base respectively.

4. The connection device of claim 1, wherein the second elastic portion and the first elastic portion are adjacent to the upper portion and the lower portion of the bracket respectively.

5. The connection device of claim 1, wherein the base includes an upper wall and a lower wall, the upper wall includes a first wall section and a second wall section bent with respect to the first wall section, the first wall section and the second wall section jointly define the upper feature, the lower wall includes a third wall section and a fourth wall section bent with respect to the third wall section, and the third wall section and the fourth wall section jointly define the lower feature.

6. The connection device of claim 5, wherein the second wall section of the base is substantially perpendicularly connected to the first wall section, and the fourth wall section of the base is substantially perpendicularly connected to the third wall section.

7. The connection device of claim 1, wherein the first elastic portion has a smaller size than the first moving space, and the second elastic portion has a smaller size than the second moving space.

8. A connection device for use with a piece of furniture, wherein the furniture comprises a first furniture member and a second furniture member, the connection device comprising:

a base configured to be mounted on the first furniture member, wherein the base has a first side and a second side, a first guiding structure is disposed adjacent to one of the first side and the second side, a first position-limiting structure is disposed adjacent to the other of the first side and the second side, and the first guiding structure and the first position-limiting structure define a first moving space therebetween, the base further being provided with an upper feature, a lower feature, and a middle wall disposed between the upper feature and the lower feature, a second position-limiting structure is disposed adjacent to the one of the first side and the second side of the base, a second guiding structure being disposed adjacent to the other of the first side and the second side of the base, the second guiding structure and the second position-limiting structure define a second moving space therebetween; and a bracket configured to be connected to the second furniture member and be movably mounted on the base, wherein the bracket is provided with a first elastic portion, the first elastic portion of the bracket being configured to be mounted in the first moving space of the base, the bracket further being provided with an upper portion, a lower portion, and a middle portion disposed between the upper portion and the lower portion, the middle portion being provided with the first elastic portion; and the upper portion and the lower portion of the bracket are configured to be respectively mounted to the upper feature and the lower feature of the base, the middle portion of the bracket being provided with a second elastic portion, and the second elastic portion of the bracket being configured to be mounted in the second moving space of the base.

9. The connection device of claim 8, wherein the first elastic portion has a smaller size than the first moving space, and the second elastic portion has a smaller size than the second moving space.

10. The connection device of claim 8, wherein the second elastic portion and the first elastic portion are adjacent to the upper portion and the lower portion of the bracket respectively.

11. The connection device of claim 8, wherein the base includes an upper wall and a lower wall, the upper wall includes a first wall section and a second wall section bent with respect to the first wall section, the first wall section and the second wall section jointly define the upper feature, the lower wall includes a third wall section and a fourth wall section bent with respect to the third wall section, and the third wall section and the fourth wall section jointly define the lower feature.

12. The connection device of claim 11, wherein the second wall section of the base is substantially perpendicularly connected to the first wall section.

13. The connection device of claim 12, wherein the fourth wall section of the base is substantially perpendicularly connected to the third wall section.

14. The connection device of claim 8, wherein the base includes a connecting hole, and the base is connected to the first furniture member by passing a fixing member through the connecting hole.

15. The connection device of claim 8, wherein the base includes at least one mounting feature, and the base is connected to the first furniture member through the at least one mounting feature.

16. The connection device of claim 8, wherein the first furniture member is a cabinet, the second furniture member is a slide rail, and the slide rail has a length direction substantially perpendicular to the base.

17. A connection device, comprising:

a base; and a bracket movably mounted on the base;

wherein one of the base and the bracket has a first side and a second side, a first guiding structure and a second position-limiting structure are provided adjacent to one of the first side and the second side, and a first position-limiting structure and a second guiding structure are provided adjacent to the other of the first side and the second side;

wherein the first guiding structure and the first position-limiting structure define a first moving space therebetween, and the second guiding structure and the second position-limiting structure define a second moving space therebetween;

wherein the other of the base and the bracket is provided with a first elastic portion and a second elastic portion, the first elastic portion is configured to be mounted in the first moving space, and the second elastic portion is configured to be mounted in the second moving space.

* * * * *